United States Patent [19]

Ingham et al.

[11] Patent Number: 4,658,545

[45] Date of Patent: Apr. 21, 1987

[54] AUTOMATIC DOOR OPENER AND CLOSER

[76] Inventors: Steven G. Ingham; Gary G. Ingham, both of 3728 NW. 25, Oklahoma City, Okla. 73107

[21] Appl. No.: 745,118

[22] Filed: Jun. 17, 1985

[51] Int. Cl.[4] ..... E05F 15/04

[52] U.S. Cl. ..... 49/340; 49/28; 49/29; 49/264

[58] Field of Search ..... 49/340, 334, 264, 29, 49/30, 263, 26, 28

[56] References Cited

U.S. PATENT DOCUMENTS

| | | | |
|---|---|---|---|
| 2,639,142 | 5/1953 | Morgan et al. | 49/340 |
| 3,114,541 | 12/1963 | Coffey | 49/340 X |
| 3,284,950 | 11/1966 | Gute | 49/340 X |
| 3,370,381 | 2/1968 | Wetter | 49/340 X |
| 3,425,161 | 2/1969 | Catlett et al. | 49/340 X |
| 3,864,875 | 2/1975 | Hewitt | 49/334 X |
| 3,874,117 | 4/1975 | Boehm . | |
| 3,886,425 | 5/1975 | Weiss | 49/340 X |

FOREIGN PATENT DOCUMENTS

| | | | |
|---|---|---|---|
| 1057062 | 2/1967 | United Kingdom | 49/264 |

*Primary Examiner*—Philip C. Kannan

*Attorney, Agent, or Firm*—Robert K. Rhea

[57] ABSTRACT

In a door opening and closing apparatus a reversible drive motor and door actuator are mounted in the framing above a door header. The vertically disposed drive shaft of the motor is connected with the door actuator through a friction clutch equipped drive train including a series of speed reducing torque increasing cog belts and pulleys. The drive train operates pivoting linkage secured at one end to the door for biasing the door open or closed in response to the direction of rotation of the drive motor. A circuit connects a source of electrical energy with the drive motor through a plurality of current switching relays also inducing magnetic flux in the field windings of a braking slave motor driven by the driving motor. Door opening action is initiated by a foot pressure switch.

4 Claims, 6 Drawing Figures

AUTOMATIC DOOR OPENER AND CLOSER

BACKGROUND OF THE INVENTION

1. Field of the Invention

The present invention relates to automatic door operators and more particularly to a door opener and closer.

Automatic operators for entry and exit doors are in general use, such as for airports, department stores, office buildings and other high volume traffic areas where pedestrians may be carrying luggage, or the like. Automatic operators for such doors are usually installed in the transom area of the door and are generally actuated by walk-on approach mats or an electric eye. Automatic door operators are generally relatively complex and, therefore, initially expensive as well as costly to maintain since they require frequent service and experienced service personnel.

2. Description of the Prior Art

Automatic door operators presently in use, whether they be of the type which opens the door and utilize a conventional door check or wound up spring for closing the door or are of the type which both opens and closes the door, have generally been powered by an electric motor having its drive shaft horizontally disposed. This horizontal disposition of the drive shaft is necessitated for convenience in a space restricted area for connection with the necessary worm screw and gear train drive interposed between the motor drive and door connected operating arm, the gear train usually being in an oil filled gear case to maintain the gears lubricated which is the most frequent source of maintenance problems.

U.S. Pat. No. 3,874,117 is an example of this type of electric motor drive gear train door opener.

This invention is distinctive over the prior art and this patent by disposing a door opening and closing drive motor with its drive shaft vertical and connecting the motor with a door operating arm through a transom drive formed by a series of cog belts and pulleys which also includes a friction clutch as a safety feature and for the protection of the equipment and increasing its useful life.

SUMMARY OF THE INVENTION

The door opener and closer is mounted in the transom area of the door to be operated and may be installed on either right hand or left hand doors and can be utilized to operate with either center hung or both hinged doors opening in either direction without modification of the opener or the door. The door operator includes a drive motor having its drive shaft disposed vertically and connected with a door operating arm by a drive train comprising a plurality of speed reducing torque increasing pulleys and cog belts. A friction clutch connecting the drive train with a motor driven pulley prevents damage to the drive train in the event a door is blocked when the motor is energized and permits manual override in opening or closing of the door in the event of electrical power interruptions.

An electric circuit connects a source of electrical energy with the drive motor through an actuator switch which may be in the form of a walk-on approach mat or a photoelectric eye, usually located adjacent but spaced from the door a distance sufficient for door opening movement in front of an approaching pedestrian. A safety switch is also included in the circuit and located under a safety mat adjacent the door in its opening direction to prevent operation of the door opener in the event a person or object is adjacent the door. The circuit includes a time delay to insure complete opening of the door as well as providing sufficient time for a pedestrian to clear the door swinging area.

The circuit further includes cam operated door opening and closing movement checks to decrease the speed of door opening and closing movement prior to the actuation of cam operated door open and close limit switches at the respective limit of movement of the door in its opening and closing action.

The principal object of this invention is to provide a door opening and closing mechanism eliminating the usual worm screw and oil filled gear box by utilizing an electric motor having its drive shaft vertically disposed and utilizing cog belts and pulleys as a speed reducing torque increasing drive train between the motor and a door operating arm which requires a minimum of maintenance.

DESCRIPTION OF THE PREFERRED EMBODIMENTS

Figure 2:
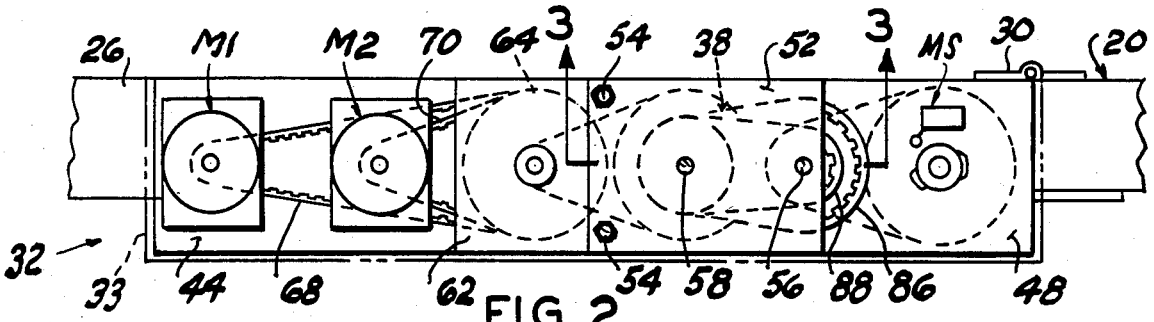
FIG. 2 is a top view of FIG. 1 with the position of the protective cover indicated by phantom lines.

Like characters of reference designate like parts in those figures of the drawings in which they occur.

Figure 1:
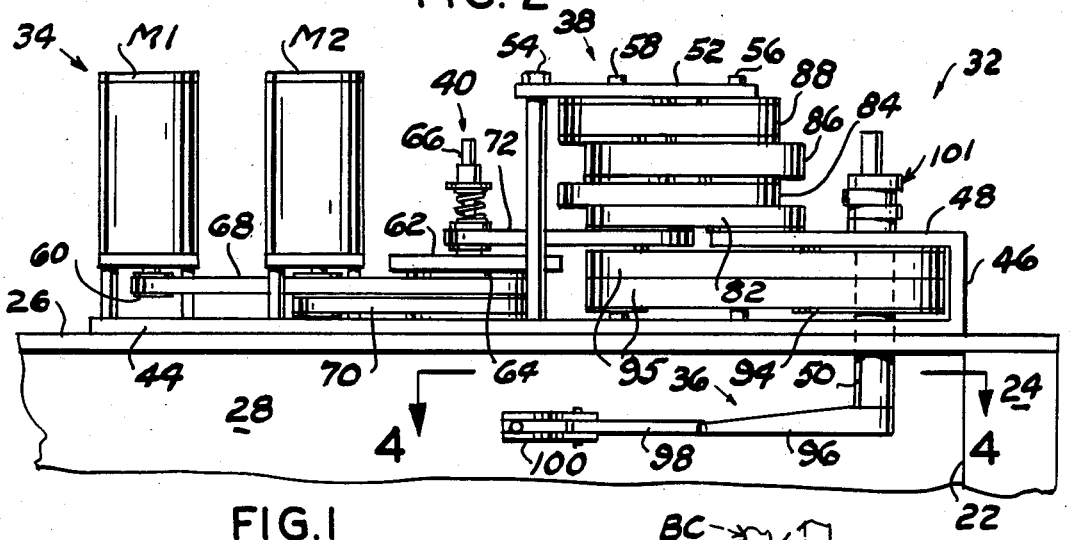
FIG. 1 is a fragmentary side elevational view of the device operatively connected with a door and having its protective cover removed.

In the drawings:

Referring to FIGS. 1 and 2, the reference numeral 20 indicates a fragment of a wall having a door opening 22 therein, partially defined by door jambs 24, only one being shown, which are spanned at their upper limit by a lintel or transom bar 26. A door 28 opens and closes the opening 22. The door is hung by a plurality of hinges 30 at one side of the door opening for horizontal pivoting movement about the vertical axis of the hinges 30 during its opening and closing action.

The reference numeral 32 indicates the automatic door opening and closing unit which is mounted on the transom bar 26 and extends generally longitudinally thereof in overlying relation. The door opener is contained by a cover 33 and generally comprises motor means 34 drivably connected with door actuator arm means 36 by drive train means 38 with clutch means 40 interposed in the drive train. The unit 32 further includes control means represented by the circuit 42 (FIG. 6), as presently explained.

Figure 3:
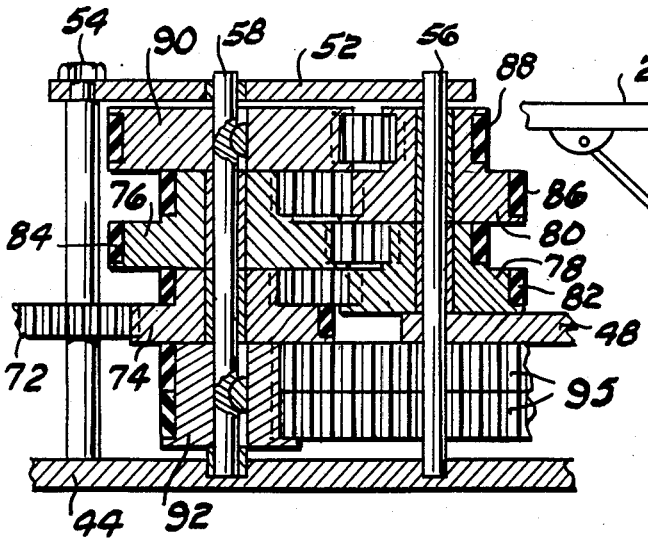
FIG. 3 is a fragmentary vertical cross sectional view, to a larger scale, taken substantially along the line 3—3 of FIG. 2.

Referring also to FIG. 3, the door operator 32 is mounted on a base plate 44 which is secured to the transom bar 26. The end portion of the base plate 44, adjacent the jamb 24, extends upwardly a selected distance at right angle, as at 46, and then projects horizontally shelf-like toward the other end of the base plate a selected distance, as at 48, to form a box-like configuration of the base plate for vertically journalling a door arm actuator pulley shaft 50 projecting downwardly through the transom bar 26, as presently explained.

A top frame plate 52 horizontally overlies the base plate in vertical spaced relation with respect to the plane of the base shelf 48 and is supported by a pair of posts 54 disposed intermediate the length of the base plate. A pair of pulley axles 56 and 58 extend vertically between the top plate 52 and the base plate 44. The pulley axle 56 extends through the base plate shelf 48 and is stationary. The pulley axle 58 is journalled for angular rotation about its axis by the base plate 44 and top plate 52 for the purposes presently explained.

The motor means 34 includes a prime mover comprising a first reversible direct current electric motor M1 mounted on the end portion of the base plate opposite the door jamb 24 with the axis of the motor drive shaft vertically disposed and its pulley 60 preferably adjacent the upper surface of the base 44. A second slave non-drive electric motor M2 is similarly drive shaft pulley equipped and mounted vertically adjacent the motor M1. An intermediate pulley support plate 62 is horizontally supported above and by the base plate 44 between the motor M2 and posts 54 in vertically spaced relation with respect to the base. The purpose of the plate 62 is to support, in combination with the base plate 44, the clutch means 40 and journal a dual groove driven pulley 64 mounted on the vertical shaft 66 of the clutch means. The drive pulley 60 of the motor M1 is connected with the driven pulley 64 by a belt 68. Similarly, a belt 70 connects the drive shaft pulley of the slave motor M2 with the other groove of the dual pulley 64.

The clutch means 40 is a conventional adjustable friction clutch engaging and releasing the pulley 64 and includes a drive pulley connected by a belt 72 with one groove of a dual groove idler pulley 74 bearing journalled by the pulley axle 58. A second similar dual groove idler pulley 76 is bearing journalled by the axle 58 above the first idler pulley 74. Similarly, third and fourth dual groove idler pulleys 78 and 80 are bearing journalled in superposed relation on the fixed pulley axle 56 above the frame shelf 48. Each of the idler pulleys 74–80 are identical having a lower larger diameter pulley groove and an upper reduced diameter pulley groove so that a like series of belts 82, 84, 86 and 88, respectively, entrained around the pulleys progressively reduce the angular rate of rotation imparted by the drive motor M1 and increases the torque which is applied to the pulley axle 58 by a driven pulley 90 secured thereto above the idler pulley 76 and driven by the uppermost belt 88. The depending end portion of the angular rotating pulley axle 58 is fixed to a small diameter pulley 92 drivably connected with a door arm pulley 94, axially secured to the door actuator arm shaft 50, by belts 95.

The arm means 36 comprises a pivot arm 96 rigidly secured at one end to the depending end of the door arm actuation shaft 50 and pivotally connected, at its other end, to one end of a link 98 having its other end secured to a bracket 100 fixed to the adjacent surface of the door 28. Thus angular rotation of the motor M1 drive shaft pulley 60 in one direction rotates the arm shaft 50 in a direction to bias the door open while angular rotation of the motor in the opposite direction angularly rotates the arm shaft 50 in a door closing movement. This action is controlled by the circuit means 42, as presently explained.

Cam means 101 is mounted on and angularly rotates with the shaft 50 above the shelf 48. The cam means includes four generally circular superposed camming surfaces which respectively activate four similarly superposed microswitches, only one being shown at MS (FIG. 2), and forming a part of the control circuit 42.

The circuit 42 includes a series of switching means comprising five relays R1, R2, R3, R4 and R5. In addition to the coil end terminals numbered 7 and 8, relays R1, R3, R4 and R5 each contain contacts 1, 2, 3, 4, 5, 6 with an armature connected respectively with contacts 5 and 6 and normally closed with contacts 1 and 2, respectively, when the armature coil is de-energized. The coil of relay R2 includes end terminals 13 and 14 and contacts numbered 1 through 12 with an armature connected with each contact 9, 10, 11 and 12 normally closed, when the coil of relay R2 is de-energized, with contacts 1, 2, 3 and 4, respectively.

A source of electrical energy AC is connected with the coil of relay R1 and normally maintains its armatures closed with its contacts 3 and 4. A transformer T, connected across the current source, has its secondary winding connected with a 12 volt bridge 102 and a 90 volt bridge 104. The positive output of 12 volt bridge 102 is connected with relay R2 coil terminal 13 through a time delay TD. The negative terminal of bridge 102 is connected to relay R2 coil terminal 14 by a wire 106 and to relay R2 contact 12. Relay R2 contact 4 is connected by wire 108 to one end of a safety resistor SR with the other terminal of the safety resistor connected with the positive lead of the bridge 102 between the bridge and time delay TD. A circuit and motor activating normally open switch AS is connected between the 12 volt bridge end of the safety resistor SR and the relay R2 coil terminal 13. The normally open activating switch AS may comprise a plurality of such switches connected in parallel normally disposed beneath an approach or walk-on mat, not shown, in the path of pedestrians, the switch being closed by foot pressure. Obviously, the switch AS may comprise a photoelectric eye or cell, as mentioned hereinabove.

A normally open safety switch SS is similarly connected with the safety resistor SR at its end opposite the activating switch AS and with the relay R2 coil terminal 13, the safety switch SS similarly underlying the approach mat near the door 28 on that side toward the door opening direction. When closed, the safety switch prevents energizing the coil of relay R2 by the closing of the activating switch AS in the manner presently explained. Relay R2 contact 7 is connected with one wire of the AC source.

Relay R3 coil terminal 7 is similarly connected with one wire of the AC source and its coil terminal 8 is connected with relay R2 armature contact 11 so that when the coil of relay R2 is energized the coil of relay R3 is energized.

The coil terminal 7 of relays R4 and R5 are respectively similarly connected with one wire of the AC source. The coil terminal 8 of relay R4 is connected with the other wire of the AC source through a normally open door back-check microswitch BMS. Similarly, coil terminal 8 of relay R5 is connected with the other wire of the AC source by a normally open door latch microswitch LMS.

The positive output of the 90 volt bridge 104 is connected with relay R3 contact 4 through a normally closed door opening limit microswitch OMS. The positive output of the bridge 104 is also connected with relay R3 contact 1 through a normally closed door closing limit microswitch CMS. Relay R3 armature contact 5 is connected with relay R1 contact 5 by a wire 109. Relay R1 armature contact 3 is connected with motor M1 terminal 110 by a wire 112.

The negative terminal of 90 volt bridge 104 is connected with a motor M1 current control resistor M1R by a wire 114. The other terminal 116 of motor M1 is connected by a wire 118 with relay R3 contact armature 6.

Relay R3 contact 2 is connected with relay R5 armature contact 5 by a wire 120. Relay R3 contact 3 is connected with relay R4 armature contact 5 by a wire 122.

Relay R1 contact 4 is connected to motor M2 terminal 138 by a wire 126. A motor M2 resistor M2R is connected with the other terminal 124 of motor M2. Relay R1 armature contact 6 is connected with relay R2 armature contact 9 by a wire 128.

Relay R2 contact 1 is connected with relay R5 armature contact 6 by a wire 130 and relay R2 contact 5 is connected with relay R4 armature contact 6 by a wire 132.

Relay R4 contacts 1 and 3 are connected by wires 134 and 136, respectively, at selected locations adjacent the end of resistor M1R connected with the wire 114. Similarly, relay R4 contact 2 is connected with motor M2 resistor M2R at its end portion opposite the terminal 124 by a wire 140 and relay R4 contact 4 is connected by a wire 142 with an intermediate portion of motor M2 resistor M2R.

Relay R5 contacts 1 and 3 are respectively connected with motor M1 resistor M1R at selected locations by wires 144 and 146.

Similarly, relay R5 contacts 2 and 4 are respectively connected at selected locations with resistor M2R adjacent the motor M2 terminal 124 by wires 148 and 150.

Operation

Figure 4:
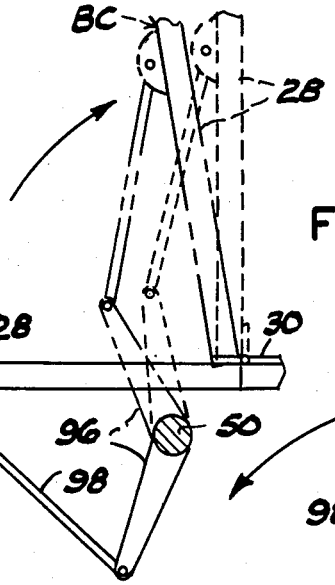
FIG. 4 is a fragmentary diagrammatic view of the door opening action, partially in section, looking in the direction of the arrows 4—4 of FIG. 1.

In operation, a pedestrian approaching the door steps on the approach mat, not shown, which closes the activating switch AS and energizes the coil of relay R2. Relay R2 contact 11 armature closes with its contact 7 thus energizing the coil of relay R3 so that its contact 6 armature closes with its contact 4. This applies positive voltage from the 90 volt bridge 104 over wire 118 to the terminal 116 of motor M1 to complete a circuit through the motor to the negative side of the bridge 104 over wire 112 through relay R1 contacts 3 and 5, wire 109, relay R3 contacts 5 and 3 over wire 122 through relay R4 contacts 5 and 1 and wire 134 to the resistor M1R and negative wire 114. This door opening action continues until the door approaches within 10° to 15° of full 90° opening, as diagrammed in FIG. 4, where one of the cams 101 closes the normally open back-check microswitch BMS, as illustrated by phantom lines and designated BC. Closing switch BMS energizes the coil of relay R4 and moves its contact 5 armature to make with its contact 3 thus impressing a selected value of the resistance of resistor M1R on the motor M1 circuit which decreases the angular rate of rotation of motor M1.

The door is further moved toward its full open position by the circuit driving motor M1 until one of the cams 101 opens the door open limit switch OMS interrupting the motor M1 circuit. Simultaneously the time delay TD has maintained the coil of relay R2 energized, after the opening of activator switch AS, to complete the door opening action.

During the motor driven opening of the door, motor M2 applies resistance to the circuit by the motor M2 terminal 138 connected by wire 126 through contacts 4 and 6 of relay R1 over wire 128 and through contacts 5 and 9 of relay R2 and over wire 132 through relay R4 contacts 2 and 6 and wire 140 to the end portion of motor M2 resistor M2R opposite terminal 124 to apply full resistance of this resistor to the field of motor M2. When the cam closes the back-check microswitch BMS, relay R4 is energized to move its contact 6 armature to close with contact 4 to complete the above motor M2 field circuit over wire 142 and impress a smaller resistance value on the field of motor M2.

In the event a person or some object is on the approach mat adjacent the door in its direction of opening movement and has closed the normally open safety switch SS, the safety resistor SR is impressed on the 12 volt bridge 102 circuit over wire 106 and through the relay coil in which the safety resistor SR decreases the potential applied to relay R2 to a value insufficient to energize relay R2 thus preventing the above described door opening action by a person on the approach mat closing the activating switch AS.

Figure 5:
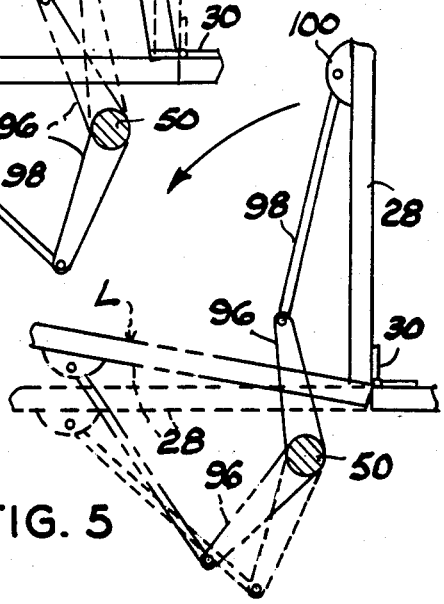
FIG. 5 is a view similar to FIG. 4 of the door closing action.
Figure 6:
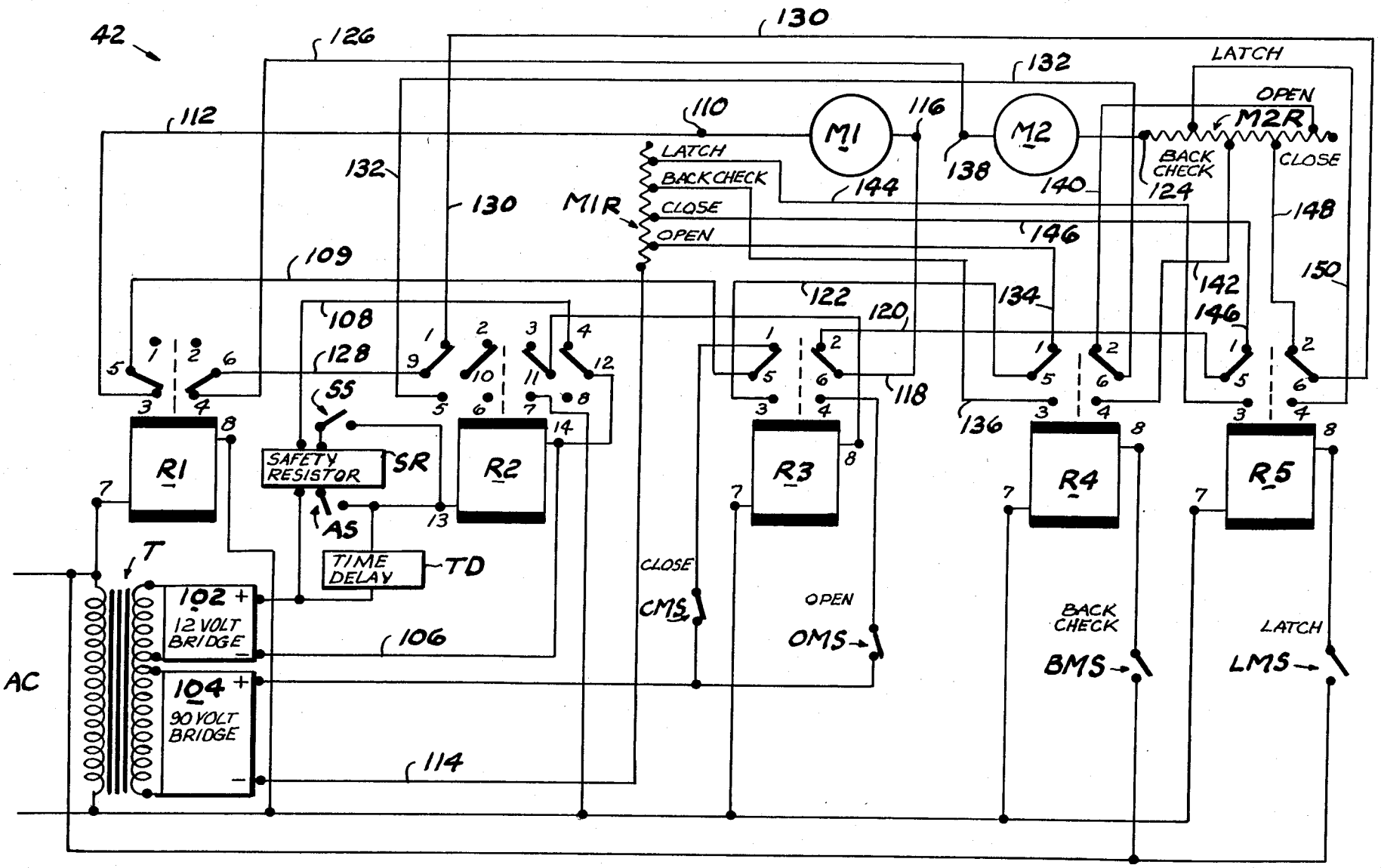
FIG. 6 is a wiring diagram.

With the door in full open position and the predetermined time delay of time delay TD expired, the coil of relay R2 is de-energized restoring its armatures to the position shown by FIG. 6 thus also de-energizing relay R3. With relay R3 de-energized positive current from the 90 volt bridge 104 is applied to the terminal 110 of motor M1 through the closing limit switch CMS, relay R3 terminals 1 and 5, wire 109, relay R1 terminals 3 and 5 and wire 112. The negative side of the circuit is completed by wire 118, relay R3 contacts 2 and 6, wire 120, relay R5 contacts 1 and 5 to the end portion of the motor M1 resistor M1R connected with negative wire 114. The door closing action continues until, as diagrammed by FIG. 5, the door approaches a selected position 10° to 15° short of full closing, as illustrated by a phantom line latch position L where another one of the cams 101 closes the normally open latch microswitch LMS which energizes the coil of relay R5. Energizing relay R5 moves its contact 5 armature to make with its contact 3 connected with wire 144 to apply substantially the full resistance of the resistor M1R to the motor M1 circuit.

Simultaneously the motor M2 applies a braking resistance to the door closing action of motor M1 by the flux of substantially the major portion of resistance of motor M2 resistor M2R applied to the field of motor M2 from its terminal 138 over wire 126, the contacts 4 and 6 of relay R1, wire 128, relay R2 contacts 1 and 9, wire 130, relay R5 contacts 2 and 6 and wire 148 to resistor M2R. When the latch microswitch LMS closes, relay R5 energizes to switch its contact 6 armature to close with contact 4 and to the end of resistor M2R adjacent motor M2 terminal 124 by wire 150. The door closing action continues at the reduced rate of closing until the fourth one of the cams 101 opens the normally closed door closed limit switch CMS which interrupts current to the motor M1.

Obviously the invention is susceptible to changes or alterations without defeating its practicability. Therefore, we do not wish to be confined to the preferred embodiment shown in the drawings and described herein.

We claim:

1. An electric door operator operably connected with a door mounted for horizontal swinging movement of the door in a door opening below a transom bar, comprising:

motor means above said transom bar including a reversible drive motor having the axis of its pulley equipped drive shaft vertically disposed;

linkage means including a door moving shaft extending vertically through the transom bar and connected with the door;

drive train means including a series of horizontal angularly rotating motor speed reducing torque increasing pulleys and cog belts connecting said drive motor with said door moving shaft;

circuit means including a normally open pedestrian closed circuit activating switch and a series of current switching relays selectively applying current to said drive motor in a door opening or closing direction in accordance with the open or closed position of the circuit activating switch;

a source of electrical energy connected with said circuit means;

transformer means providing a direct current potential, one said relay having contacts interposed in wires connecting the positive potential with the respective terminal of said drive motor for door opening or closing movement in accordance with the energized or de-energized coil of said one relay;

door opened and closed limit switches interposed in the positive potential wires;

door opened and closed limit switch operating cams mounted on said door moving shaft;

electrical resistance means connected with the negative terminal of said direct current potential, a pair of relays of said series of relays each having at least one pair of contacts interposed in the drive motor negative potential circuit and connected with said resistance means for applying a predetermined resistance value to the drive motor circuit;

a door movement slowing switch in the coil circuit of each relay of said pair of relays for energizing the respective relay during the opening and closing movement, respectively, of said door; and, other slowing switch operating cams mounted on said door moving shaft.

2. The door operator according to claim 1 and further including:

a second speed braking motor having its drive shaft driven by said drive motor, at least one other pair of contacts of each relay of said pair of relays being connected with the field windings of said second motor; and, other electrical resistance means interposed between one terminal of said second motor and the respective said other pairs of contacts of said pair of relays for inducing a predetermined magnetic flux in the field windings of said second motor in response to the closing of the respective door movement slowing switch.

3. The door operator according to claim 2 in which the circuit means further includes:

safety switch means interposed in the circuit means for preventing energizing said drive motor in response to an obstruction in the door opening movement path; and, a time delay means in parallel with said activating switch for maintaining the drive motor circuit closed for a predetermined time interval after the opening of the activating switch.

4. The door operator according to claim 3 and further including:

a friction clutch means interposed between said drive motor and said drive train means for permitting free wheeling movement of the drive train components independently of said drive motor in response to manual movement of said door in either direction when the drive motor terminal connected said one relay is de-energized.

* * * * *